United States Patent [19]

McNally

[11] Patent Number: 4,573,680

[45] Date of Patent: Mar. 4, 1986

[54] FOOTBALL TRAINING APPARATUS AND METHODS OF USING SAME

[76] Inventor: James C. McNally, 1831 Poplar Dr., Loveland, Ohio 45140

[21] Appl. No.: 589,654

[22] Filed: Mar. 14, 1984

[51] Int. Cl.[4] ..... A63B 67/00

[52] U.S. Cl. ..... 273/55 R; 124/36

[58] Field of Search ..... 273/55 R, 55 A

[56] References Cited

U.S. PATENT DOCUMENTS

| | | | |
|---|---|---|---|
| 2,696,383 | 12/1954 | Noftsinger | 273/55 R |
| 2,820,365 | 1/1958 | Detzel . | |
| 3,044,776 | 7/1962 | Weidmaier et al. . | |
| 3,237,944 | 3/1966 | Kopp . | |
| 3,329,428 | 7/1967 | Moran | 273/55 R |
| 3,443,810 | 5/1969 | Drakulich . | |
| 3,451,677 | 6/1969 | Nedwick . | |
| 3,458,192 | 7/1969 | Trice, Jr. | 273/55 R |
| 3,514,105 | 5/1970 | Pillard | 273/55 R |
| 3,556,523 | 1/1971 | Hooker | 273/55 R |
| 3,578,324 | 5/1971 | Alvey . | |
| 3,580,574 | 5/1971 | Hornak . | |
| 3,649,016 | 3/1972 | Kelley, Jr. . | |
| 3,674,265 | 7/1972 | Sheets et al. . | |
| 3,684,283 | 8/1972 | Forrest . | |
| 3,804,410 | 4/1974 | Gilman . | |
| 3,827,690 | 8/1974 | Rodgers . | |
| 3,889,949 | 6/1975 | Gardner . | |
| 3,897,060 | 7/1975 | Jennings | 273/55 R |
| 3,907,291 | 9/1975 | Parker . | |
| 3,997,160 | 12/1976 | George . | |
| 4,067,571 | 1/1978 | Rogers . | |
| 4,087,089 | 5/1978 | Forrest . | |
| 4,140,315 | 2/1979 | Page, Jr. . | |

OTHER PUBLICATIONS

"World Sporting Goods, Inc. 1981 Equipment Catalogue", World Sporting Goods, Inc. (1981).

"Gilman Gear", Marty Gilman, Incorporated.

"Best on the Block '81", Rodgers Athletic Company (1981).

"The Wonderful World Of . . . ", Continental Athletic Supply Co.

*Primary Examiner*—Richard C. Pinkham

*Assistant Examiner*—T. Brown

*Attorney, Agent, or Firm*—Wood, Herron & Evans

[57] ABSTRACT

An apparatus for training football techniques comprising a movable frame for lateral movement supported by a support frame. The movable frame can be vertically adjusted within the support frame to accommodate large as well as small football players. An impact member having a padded area for reciprocal movement between a retracted and an extended position is mounted on the movable frame. The impact member reciprocates outwardly and generally toward a player. Both the movable frame and the impact member can be selectively operated either simultaneously or independently by an operator standing on a platform supported by the support frame. An operator can selectively move the movable frame laterally in either direction while selectively releasing the impact member from its retracted position for advancement toward the player. The player reacts to the movement of both the movable frame and the impact member, and contacts the extended impact member for returning the same to its retracted position for rapid, repeated contact.

18 Claims, 3 Drawing Figures

FOOTBALL TRAINING APPARATUS AND METHODS OF USING SAME

BACKGROUND OF THE INVENTION

Training apparatuses for teaching players techniques incident to the play of football are known in the prior art. Examples of such known devices are disclosed in U.S. Pat. No. 3,329,428, issued July 4, 1967, to J. A. Moran; U.S. Pat. No. 3,514,105, issued May 26, 1970, to H. P. Pillard; U.S. Pat. No. 3,649,016, issued Mar. 14, 1972, to R. E. Kelly, Jr.; U.S. Pat. No. 3,674,265, issued July 4, 1972, to H. L. Sheets and R. W. Booth; U.S. Pat. No. 3,897,060, issued July 29, 1975, to R. E. Jennings; and Rogers Athletic Company's "Mod Mover" in Best on the Block, p. 12, 1981.

The apparatus of U.S. Pat. No. 3,329,428 is a charging device designed specifically to simulate the charge of an opposing lineman in the direction of a player. Such a device provides for a coach to selectively release a lock to enable an impact bag to travel in a direction toward a player. The player, in turn, charges the impact bag to contact the same for returning the impact bag back to its locked position. This apparatus, however, relies exclusively upon an extended, rather than retracted, tension spring to provide the necessary means for moving the impact bag in the direction toward a player. Further, even though such device may be employed to teach both offensive and defensive lineman techniques using either shoulder blocks or hand charges, it is unfortunately limited only to simulate the charge of an opposing lineman directly at a player. Since under actual game conditions, the movement of an opposing lineman is not limited to a direct charge on a player, such device fails to expose to the player actual game-like conditions.

The tackling sled of U.S. Pat. No. 3,674,265 is nothing more than a modification of U.S. Pat. No. 3,329,428 in that it provides a training device which simulates the initial charge and retreat reactions of a football lineman. Such sled employs basically three sets of compression springs for its movement wherein the first set urges the plunger having a pad secured thereto toward its extended position and opposes motion toward its retracted position, while the forward motion of the plunger is resiliently limited by a second set, and the rearward motion is resiliently limited by the third set. Like the sled of U.S. Pat. No. 3,329,428 the pad relies upon the contact of a charging player to return it back to its locked position. Such sled additionally provides for the angle of the plunger stroke and the force of the springs to be adjusted so that lineman utilizing different types of charge and retreat reactions can be simulated. Nevertheless, as with the typical apparatus described in U.S. Pat. No. 3,329,428, such sled is likewise limited only to simulate the charge of an opposing lineman generally directly toward a player. Thus, such sled also fails to expose to a player actual game-like conditions.

The sled of U.S. Pat. No. 3,514,105 overcame one of the problems attendant with the typical apparatuses disclosed in U.S. Pat. No. 3,329,428 in that it provides a reactor dummy, i.e., an impact bag, on a movable frame mounted on a sled that may move horizontally laterally in either direction while providing downward and forward force against the charging player. Further, such sled can provide freely sliding movement away from the charging player. For its downward and forward force, the sled relies exclusively on springs for yielding tension biased between a stop plate located on the movable frame and a spring plate located on the reactor dummy. With respect to the sled's freely sliding horizontal movement, the sled is mounted onto runners and rollers for sliding horizontal movement on either the runners or runners and rollers; however, the horizontal movement results only when the reactor dummy is contacted by the charging player. The coach, therefore, is limited to selectively manipulating the reactor dummy horizontally laterally in either direction. Unfortunately, such improved sled is unable to simulate the charge of an opposing lineman toward a player. Thusly, while the sled provides conditions for horizontal lateral movement and sliding horizontal movement away from the charging player, it cannot simulate actual game-like situations since it fails to expose to the player a charge by an opposing lineman generally toward the player. Nor can the sled be reset by the contact of the player for rapid, repeated contacts.

The apparatus of U.S. Pat. No. 3,897,060 basically improves upon one of the disadvantages associated with the typical sled of U.S. Pat. No. 3,514,105 in that it provides a pad mounted on a supporting assembly for reciprocal movement in a direction toward and away from a player. Such apparatus simply operates with coil springs for rendering resistance to the backward movement of the pad under an applied force presented by a charging player, and for urging the assembly in the forward direction once the force applied by the player is removed. Unfortunately, such apparatus is unequipped for lateral movement as shown with the sled of U.S. Pat. No. 3,514,105, and like such sled, this apparatus is unable to replicate the charge of an opposing lineman generally directly toward a player. Such apparatus, thusly, cannot create game-like conditions where an opposing lineman charges at a player either generally directly or generally directly while simultaneously moving horizontally laterally.

The Mod Mover as disclosed in Rogers Athletic Company's brochure, "Best on the Block," '81, is also an improvement of the typical sled shown in U.S. Pat. No. 3,514,105 in that it provides a pad for lateral horizontal movement mounted on special bearings that allow it to glide freely and quickly, and be manipulated manually by an operator. Nevertheless, as with the sled disclosed in U.S. Pat. No. 3,514,105 and the apparatus of U.S. Pat. No. 3,897,060, the Mod Mover cannot duplicate the on-coming charge of an opposing lineman generally directly toward a player. Thus, the Mod Mover exposes the player to inferior game-like situations. Further, the Mod Mover is designed low to the ground limiting its usefulness as an aid for teaching football techniques, such as offensive pass blocking techniques.

Finally, the trainer of U.S. Pat. No. 3,649,016 overcame a problem common to both the typical apparatus of U.S. Pat. No. 3,329,428 and the basic sled of U.S. Pat. No. 3,514,105 in that it provides a padded dummy mounted on a frame which can be extended, retracted or swung to either side in any combination of moves under the control of an operator. This improved trainer, however, is insensitive and fails to respond to the impact delivered by a charging player. Additionally, the padded dummy is limited to a rotational lateral movement pivoting about a pin. Thus, while the trainer provides a padded dummy which is movable and designed to simulate an opponent who is dodging, it cannot respond to the impact of a charging player nor can it be reset by the impact of a charging player for rapid, repeated contact by that player. Further, the degree of horizontal lateral movement about the pivot is limited to the extent in which the padded dummy extends outwardly toward the charging player.

In other words, all of the football training apparatuses provided hitherto invariably necessarily lack some of the fundamental elements required to simulate the physical reactions ordinarily provided, for instance, by a charging defensive lineman under actual game conditions. Consequently, there are needs for training apparatuses that can provide players with more realistic playing conditions generally encountered during a football game.

SUMMARY OF THE INVENTION

In brief, the present invention seeks to alleviate the above-indicated problems and shortcomings of the present state of the art and is directed to a new and improved apparatus for training football techniques. In a preferred form, the apparatus comprises a support frame provided with a first end and a second end, a movable frame mounted on said support frame for selected lateral movement with respect to the first and second ends, an impact member having a padded area mounted on said movable frame for reciprocal movement between an extended and a retracted position, the extended position being outwardly and generally toward a player being trained on the apparatus, said impact member being returnable from its extended position to its retracted position by the player, and means for selectively releasing said impact member from its retracted position. Preferably, the training apparatus of this invention is provided with a platform for supporting an operator of the apparatus.

Additionally, the football training apparatus is designed to enable an operator to manipulate the movable frame laterally in either direction while selectively and, if desired, simultaneously advancing the impact member toward the player. Thus, in one feature of this invention, the training apparatus is designed to teach a player, for instance, those skills which are essential for successful pass blocking, i.e., the ability to move laterally on his feet in a semi-upright stance, to properly engage an oncoming defensive player who may be side stepping to avoid the offensive block, to deliver a driving forward and upright force on the defensive player, regardless of the defensive player's lateral movement, and to follow through the entire blocking maneuver to effectively neutralize and completely block the charging defensive player.

In a sense, the present invention contemplates providing a football training apparatus which can selectively simulate, for instance, a defensive player by moving laterally in either direction rapidly to avoid contact, and to selectively move toward and provide resistance to a block by extending generally outwardly and toward the player. Thus, the apparatus of this invention can be manipulated by an operator to present to a player a combination or series of lateral movements along with movements toward the player enabling the operator to more realistically duplicate the charge, for example, of an oncoming defensive lineman generally encountered during a football game. The football training apparatus of this invention is adapted, however, to teach, if desired, both offensive and defensive techniques using either shoulder blocks or hand charges.

In another feature of the present invention, the padded area can be shaped in any desired form to accommodate the football techniques being taught. In addition, the movable frame can be adjusted vertically to accommodate large as well as small football players. Thusly, the football blocking apparatus of this invention advantageously can accommodate widely different applied forces generated by persons of greatly differing sizes and strengths. Additionally, vertical adjustment of the movable frame is useful for teaching different football techniques for defensive and offensive linemen.

In still another feature of this invention is to provide a football training apparatus which is safe to both bystanders and participants during use thereof and can be repetitively used in successive and closely spaced charges by the same person. Thus, the present invention advantageously can be used by both small children such as grade-schoolers and the like as well as larger persons, such as high school, collegiate and even professional players.

In a further feature of the present invention is to provide a blocking sled which will realistically resemble the resistance encountered when a plaver blocks another human being. Thus, the football apparatus of this invention can advantageously teach a football player to complete a blocking maneuver as well as properly develop the neurokinetic reflexes required to successfully play the game of football.

In still another feature of the present invention resides in providing a portable blocking apparatus which is suitable for both outdoor and indoor use and which is nevertheless durable and capable of extended use.

In still another feature of the present invention is to provide a rugged and, if desired, easy to assemble and disassemble and convenient to store apparatus. It can withstand long and continuous hard wear and abuse and the spring members, by reason of the method of mounting, may last indefinitely. The dummies can be adjustable in number and position relative to the sled and to each other, thus adapting the blocking device to various training conditions and rendering it highly versatile.

In a further feature of the present invention is to provide a teaching apparatus which is simple and inexpensive to construct and maintain and wherein the above-mentioned modifications can be accomplished by simple mechanical operations using either readily available or easily fashioned component parts.

Thus, it can be appreciated that the special features and advantages of this football training apparatus makes it an all purpose piece of equipment, offensive and defensive.

The above and other features and advantages of the invention, including various novel details of construction and combination of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown illustrative embodiments of the invention from which its novel features and advantages will be apparent.

DETAILED DESCRIPTION OF THE INVENTION

Figure 1:
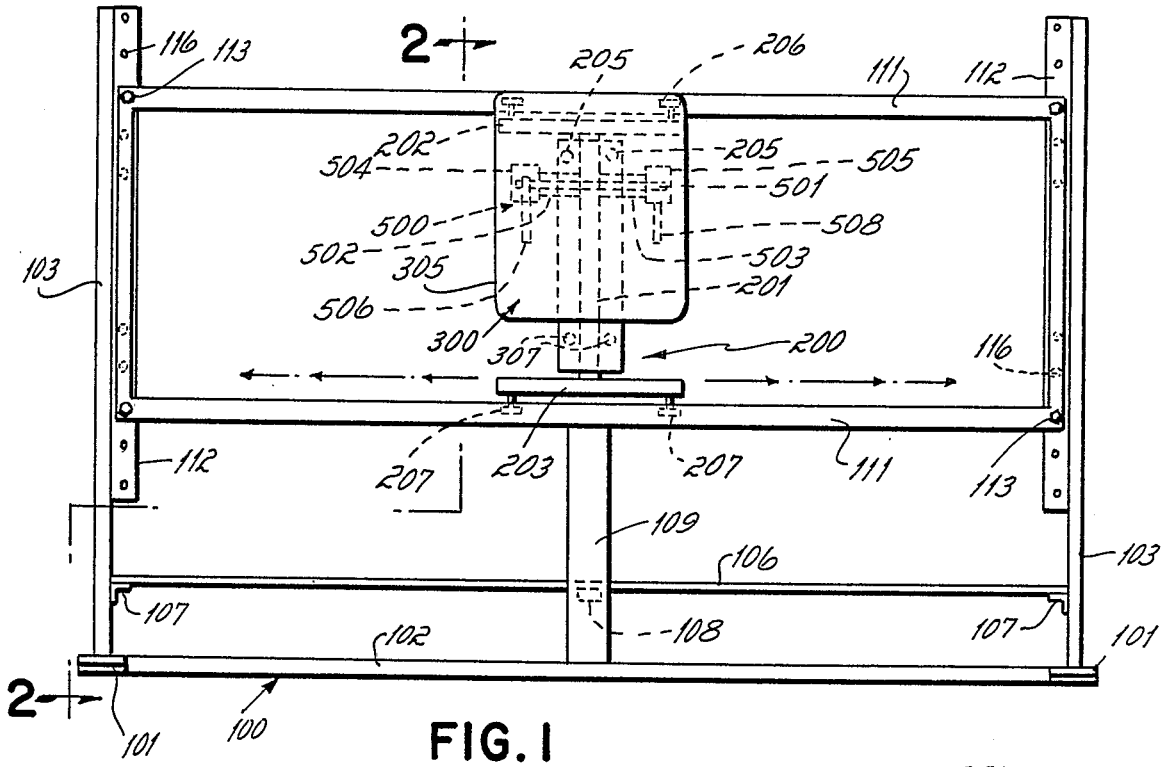
FIG. 1 is a front view of one form of a football training apparatus which is illustrative of an embodiment of the invention.
Figure 2:
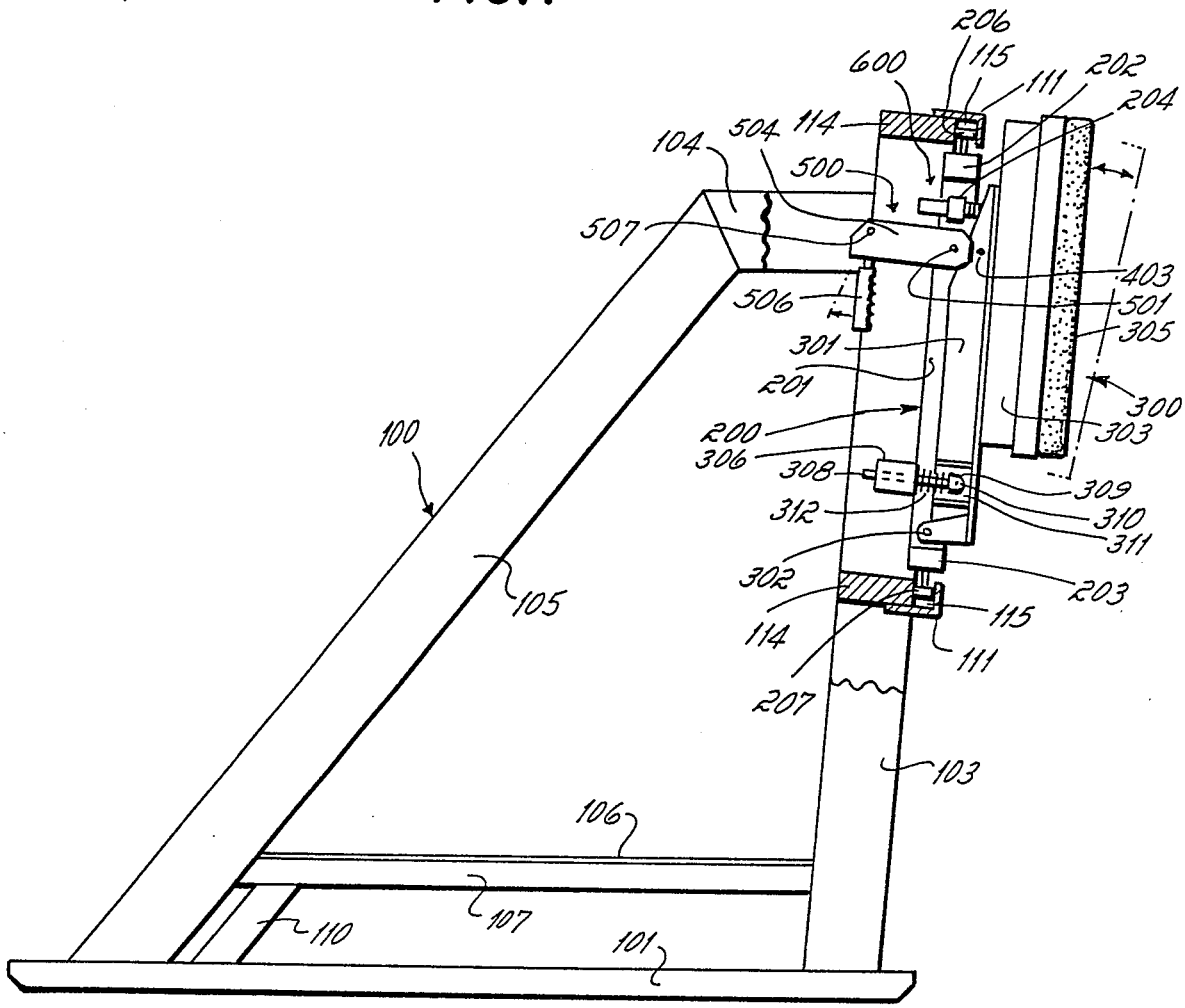
FIG. 2 is a side view partially in cross section of a football training apparatus which is illustrative of an embodiment of the invention, as seen on line 2—2 of FIG. 1. Even though only one side of the football training apparatus is illustrated in this figure, it should be understood that the other side is a mirror image of the depicted side.
Figure 3:
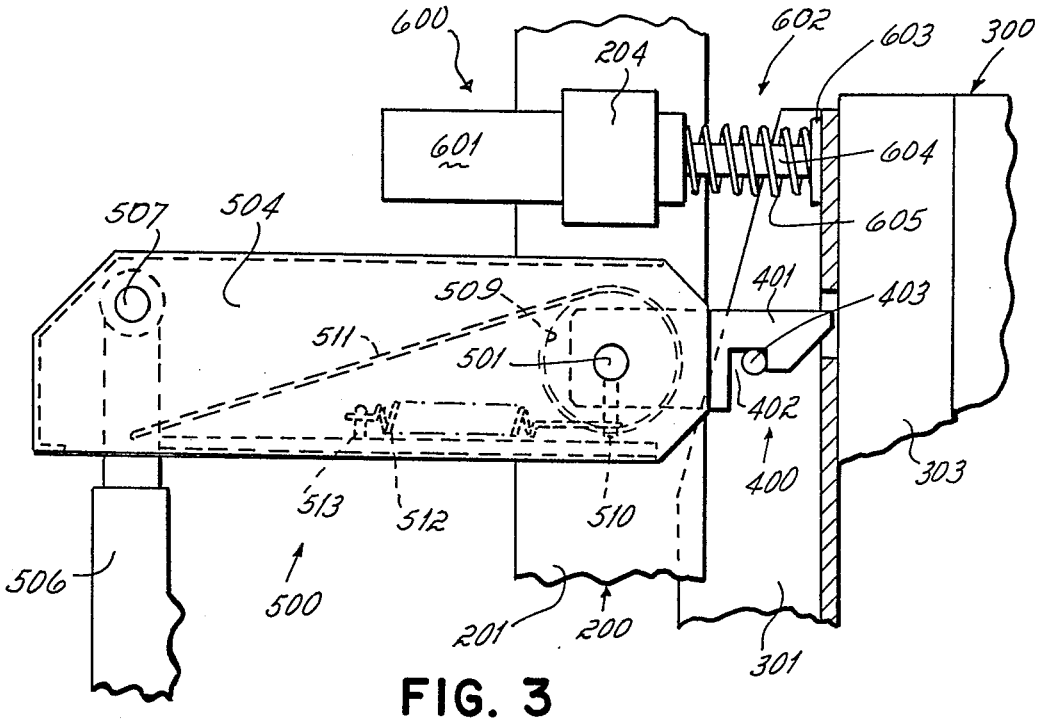
FIG. 3 is a side view of a section of a football training apparatus which is illustrative of an embodiment of the invention.

The improved football training of this invention, as exemplified by the structure depicted in FIGS. 1-3, comprises generally a support frame 100, a movable frame 200, an impact member 300, a locking means or locking assembly 400, a releasing means or releasing assembly 500 and an advancing means or actuator 600.

As illustrated in FIGS. 1 and 2, the support frame 100 is provided with two side base posts 101, a front base post 102, and a rear base post (not shown), all of which are adapted to support the support frame 100 on either outdoor or indoor surfaces. Two frontal uprights 103 are respectively secured to the side base posts 101. As means for providing support to the two frontal uprights 103, two horizontal top braces 104 are respectively connected at one of their ends to the top portions of the two frontal uprights 103, and connected at their other ends to two diagonal braces 105. The opposite ends of the diagonal braces 105 are respectively joined to the two side base posts 101 to complete the support. In this manner, the frontal uprights 103 can be positioned at any desired and suitable angle with respect to the side base posts. Nevertheless, the preferred angle is one that directs the impact member 300 to extend generally outwardly and downwardly toward a player. It should be understood, however, that single diagonal braces as opposed to the combination of diagonal and top horizontal braces, can be employed to provide support with equal success for the two frontal uprights 103. Further, the support frame 100 can be either in a rectangular shape, as depicted in FIGS. 1 and 2, or in semi-circular or circular shapes (not shown). Of course, the semi-circular shapes can be either convexed or concaved with respect to the player.

A platform 106 comprising a generally horizontal member of approximately rectangular shape which is adapted for supporting an operator, for example, a coach, trainer or player, extends transversely between the frontal uprights 103 and the diagonal braces 105. The top side of the platform can be textured or treated so as to improve footing when standing or moving thereon.

In order to provide support for the platform 106, two end beams 107 are respectively connected, for instance, by welding or with nuts and bolts (not shown) to the frontal uprights 103 and the diagonal braces 105 as depicted in FIGS. 1 and 2. Additionally, a middle beam 108 is respectively joined, also by welding or by nuts and bolts (not shown), at one end to a middle upright 109 and at the other end to a middle diagonal 110. The platform 106 is mounted on the two end and middle beams 107 and 108, respectively, by any suitable means, such as nuts and bolts or welding to maintain the same in place.

Tracks 111 as shown in FIGS. 1 and 2, are secured to two vertical braces 112 as depicted in FIG. 1 by bolts 113. The vertical braces 112 are provided with numerous apertures 116 for adjustable mounting to the frontal uprights 103 enabling vertical adjustment of the height of each track. Thus, the movable frame 200 can be vertically adjusted to accommodate large as well as small football players. It should be understood, however, that the tracks 111 should be spaced a suitable distance apart to receive the movable frame 200.

In keeping with the invention, the tracks can be of any satisfactory shape that is workable with this invention. For example, the tracks can be tubes or rails. In one exemplary embodiment, the tracks as illustrated in FIG. 2, can comprise horizontal bars 114 joined to L-shaped rails (tracks 111) and so that two U-shaped channels 115 are provided. The horizontal bars 114 can be secured to the support frame 100 by mounting the horizontal bars 114 with, for instance, bolts 113 to the vertical braces 112, on frontal uprights 103 as shown in FIG. 1.

The movable frame 200, as exemplified in FIGS. 1 and 2 is generally I in shape comprising a vertical web 201 welded to top and bottom horizontal bars 202 and 203. On each side of the vertical web 201, near the top horizontal bar 202, is welded a flange (not shown) with an ear 204. Each ear is generally centrally apertured 205, as depicted in FIG. 1, such that the apertures 205 face outwardly. Rollers or casters 206 and 207 are mounted on the top and bottom horizontal bars 202 and 203, respectively. Preferably, the rollers or casters 206 and 207 are adapted in shape to conform to the U-shaped channels 115 for moving the movable frame 200 horizontally laterally in either direction between the frontal uprights 103.

The impact member 300, as illustrated in FIGS. 1 and 2, comprises a vertical base 301 pivotally connected at one end to the front and lower end of the vertical web 201 of the movable frame 200 by pivot 302. The impact member 300 may, however, be connected to the movable frame 200 by any other suitable means so long as it does not depart from the scope of this invention. Regardless of how the impact member is connected to the movable frame, it is preferred for the impact member to extend generally outwardly and downwardly toward a player requiring the player to drive forwardly and upwardly which is essential to developing, for instance, excellent pass blocking techniques. Affixed to the vertical base 301 by any suitable means is an impact frame 303 generally having, for instance, a rectangular shape for receiving and mounting thereon a padded shield 305. The padded shield 305 can be affixed to the impact frame 303 by various means, such as ties, snaps or velcro strips attached to the padded shield 305 with the corresponding components connected to the impact frame 303. The padded shield 305 can be in any desired shape or thickness, preferably rectangular in shape, and made from any suitable material to accommodate various football techniques, such as offensive and defensive techniques using, for example, either shoulder blocks or hand charges.

Referring now to FIG. 2, a U-shaped journalled block 306 having two apertures 307, as depicted in FIG. 1, is secured in a straddled position to the lower backside of the vertical web 201 of the movable frame 200 for slidably receiving in each aperture 307 one end of a corresponding actuating rod 308. A yoke 309 is connected by a pivot 310 to a T-shaped bracket 311 near each end on the lower back portion of the vertical base 301, each yoke 309 being adjacent to one of the apertures 307 in the U-shaped journalled block 306. Each opening (not shown) in each yoke 309 can be threaded for receiving corresponding threads (not shown) on the other ends of the actuating rods 308. Slidably surrounding each actuating rod 308 and strategically positioned between U-shaped journalled block 306 in each yoke 309 is a spring 312, or any other equivalent member, such as a coil or resilient sleeve, for absorbing impact received by the impact member 300. Of course, the springs 312 have an external diameter larger than the apertures and openings (both not shown) in the U-shaped journalled block 306 and the yoke 309, respectively, and an internal diameter larger than the actuating rods 308. It should be appreciated that this assembly not only acts to limit the distance in which the impact member is advanced, but it also acts to absorb any impact received by the impact member from a player.

Turning now to FIG. 3, there is shown a locking assembly 400 for retaining the impact member 300 at its retracted position. The locking assembly 400 comprising two latches 401 mounted on a rotatable shaft 501 for rotating the latch 401 upwardly. Each latch 401 is designed with a notch 402 for engaging a corresponding locking pin 403 mounted on the upper back portion of the vertical web 301. When each latch 401 is rotated upwardly by the rotatable shaft 501, each notch 402 disengages the corresponding locking pin 403 simultaneously to release the impact member 300 at its retracted position.

The numeral 500 represents a releasing assembly, as illustrated in FIGS. 1–3, for rotating the latch 401, generally upwardly to unlock the impact member 300. The releasing assembly comprises two support sleeves 502 and 503, as shown in FIG. 1, for slidably receiving the rotatable shaft 501. Each support sleeve 502, 503 is horizontally mounted at one end by bolts (not shown) to one side of the upper portion of the vertical web 201 of the movable frame 200. Affixed to each end of support sleeves 502, 503 by bolts (not shown) are housings 504 and 505, respectively. The rotatable shaft 501 is received by each support sleeve 502, 503 for rotation therein and each end is in communication with each housing 504, 505. It should be appreciated that the rotatable shaft 501 can be a single shaft or two or more shafts connected together. A releasing handle 506 for movement between starting and releasing positions is connected at one end by pivot 507 to housing 504. In FIG. 3, the releasing handle 506 is depicted in a starting position. A fixed handle 508 is secured, by for instance, bolts (not shown), to housing 505. Mounted on the rotatable shaft 501 and contained in housing 504 is a pulley 509 and a return arm 510 as depicted in FIG. 3. Alternatively, the return arm can be contained in housing 505. A cord 511 or any other equivalent member, such as a chain, rope or string, is secured at one end to the releasing handle 506 and at the other end to the pulley 509. Of course, the cord 511 is sufficiently convoluted around the pulley 509 for turning the pulley 509 in a counterclockwise direction when the releasing handle 506 is pivoted or pulled rearwardly from its starting position to its releasing position, as shown in FIG. 3.

A return spring 512, of which is housed in housing 504, is anchored at one end to a fastener 513, or any other suitable means, and at the other end to the return arm 510. In carrying out the invention, the return spring 512 should be positioned in housing 504 such that when the releasing handle 506 is in the starting position the return spring 512 is relaxed. When the releasing handle 506 is pulled or pivoted rearwardly to its releasing position, the return spring 512 is cocked providing for rotating the pulley 509 automatically in a clockwise position for returning the releasing handle 506 from its releasing position to its starting position. It should be understood, however, that when the return arm is contained in housing 505, the return spring is anchored in housing 505 for fastening it to the return arm.

To release or unlock the impact member 300, the releasing handle 506 is pivoted or pulled rearwardly from its starting position to its releasing position. In so doing, the cord 511 rotates the pulley 509 counterclockwise which causes the rotatable shaft 501 to rotate in the same direction. In rotating the rotatable shaft 501 counterclockwise, the latch 401 is rotated upwardly releasing the impact member 300 at its retracted position. The return arm 510 is simultaneously rotated forwardly also in a counterclockwise direction to move the return spring 512 from its relaxed position to its cocked position. As a result of the tension placed upon the return spring 512 in its cocked position, the return spring 512 automatically rotates the return arm 510, the rotatable shaft 501 and the pulley 509 in a clockwise direction which causes the latch 401 to rotate downwardly and clockwise and the releasing handle 506 to rotate forwardly and counterclockwise. Thus, the return spring 512, in effect, operates to automatically return the releasing handle 506 from its releasing position to its starting position, and the latch 401 from its unlocking position to its locking position. The latch 401 is now available to lock the impact member 300 in its retracted position once returned by a player.

The advancing means or actuator 600, as exemplified in FIGS. 2 and 3 generally comprises a cylinder 601 for slidably receiving a plunger 602 having a head 603 and a shaft 604. The head 603 should have a diameter larger than the shaft 604. Surrounding the shaft 604 and strategically interposed between the head 604 and the cylinder 601 is a compression spring 605. The spring 605 generally has an internal diameter larger than the shaft 604 and an external diameter smaller than both the cylinder 601 and the head 604. Thus, both the cylinder 601 and head 604, in effect, act as stopping means for the spring 605. The actuator 600 can be selectively adjusted to provide different magnitudes of force reflected by the rate at which the impact member 300 is extended toward a player. It should be appreciated that any suitable advancing means or variation of the one described can be employed herewith so long as it functions in accordance with the teachings of this invention.

As illustrated in FIGS. 2 and 3, an actuator 600 is located in each aperture 205 of each ear 204 such that the head 603 of the plunger 602 negotiates the vertical base 301 of the impact member 300 when the impact member 300 is in its locked, retracted position. Of course, when the impact member 300 is in its locked, retracted position, the plunger 602, as shown in FIG. 3, is cocked or loaded. When the impact member 300 is in its released extended position, the plunger is also extended and the compression spring 605 is in a released state. Upon releasing or unlocking the impact member 300, the plunger 602 advances the impact member 300 generally forwardly to its extended position. In returning the impact member 300 to its locked retracted position by a player, the spring 605 not only acts to absorb the impact delivered to the impact member 300 by the player, but also to provide a sufficient amount of resistance to simulate the response of an opposing player. As stated above, the actuator 600 can be selectively calibrated at different levels thereby altering or enhancing the speed and force at which the impact member 300 is extended. Thus, by adjusting the force level of the actuator 600, a player's neurokinetic reflexes can be properly developed.

The general operation of the football training apparatus of this invention is to have an operator, e.g., a trainer, coach or player, on the platform 106 to manipulate the movable frame 200 and the impact member 300. A player, in turn, can position himself, for example, in a two, three or four point stance directly in front of or to the right or left of the shield 300. On a given count, the player can rush the shield 300 for contacting the same. Of course, the operator can manipulate the movable frame 200 horizontally laterally in either direction to avoid contact by the player. In effect, the lateral movement of the impact member 200 requires the player to respond accordingly. Additionally, the operator can selectively release the impact member 300 in a direction toward the player. Upon contacting the shield 305 of the impact member 300, the player returns the same to its locked, retracted position for rapid, repeated contact.

As described above, the football training apparatus is operated manually by an operator, such as a coach, trainer or player. Nevertheless, if desired, the football training apparatus can be automated using known techniques to enable the operator to operate both the movable frame and impact member under remote or automated control.

It should be appreciated, that this training apparatus is designed to teach various types of football skills including offensive and defensive skills using, for example, shoulder blocks or hand charges. In particular, this football apparatus is adapted to teach a player those skills essential to perfect pass blocking techniques. For example, this football apparatus teaches a player to move laterally on his feet in a semi-upright stance, to properly engage an oncoming defensive player who may be side stepping to avoid the offensive block, and to deliver rapidly and repeatedly driving forward and upright hand charges on the defense player, regardless of the defensive player's lateral movement, to effectively neutralize and block the defensive player.

The present invention may, of course, be carried out in other specific ways than those herein set forth without departing from the spirit and essential characteristics of the invention. The present embodiments are, therefore, to be considered in all respects as illustrative and not restrictive and any changes coming within the meaning and equivalency range of the appended claims are to be embraced therein.

What is claimed is:

1. An apparatus for training football techniques comprising:

a support frame having a first end and a second end;

a movable frame mounted on said support frame for selective lateral movement between the first and second ends;

an impact member having a padded area, said impact member being mounted on said movable frame for reciprocal movement between an extended and a locked retracted position, the extended position being outwardly and generally toward a player being trained on the apparatus, means on said movable frame for locking said impact member in a retracted position, said impact member being returnable from its extended position to its locked retracted position by the player;

means for selectively releasing said impact member from its locked retracted position, said movable frame and said releasing means being adapted for selective simultaneous or independent manipulation by an operator of the apparatus; and means for advancing said impact member from its released retracted position to its extended position.

2. The apparatus of claim 1 wherein said advancing means comprises an actuating assembly comprised of an actuator, a plunger and a spring for advancing said impact member from its retracted position to its extended position.

3. The apparatus of claim 2 wherein said actuating assembly is adjustable for applying a selected amount of tension on said impact member to advance said impact member with a desired speed and force.

4. The apparatus of claim 1 wherein said support frame is provided with a platform for supporting an operator of the apparatus.

5. The apparatus of claim 1 wherein said support frame is provided with a lateral track having two rails, each rail mounted on each said end of said support frame and spaced sufficiently apart for receiving said movable frame for lateral movement along the track.

6. The apparatus of claim 5 wherein said movable frame is provided with rollers for cooperation with the rails of said track.

7. The apparatus of claim 1 is further provided with means for vertically adjusting said movable frame.

8. The apparatus of claim 1 wherein said impact member is pivotally connected to said movable frame.

9. The apparatus of claim 1 is further provided with means for limiting the distance in which said impact member is advanced and for absorbing impact received by said impact member.

10. The apparatus of claim 1 wherein said releasing means comprises:

means for locking said impact member at its retracted position;

a rotatable shaft on which said locking means is mounted; and means for rotating said shaft so that it rotates said locking means to release said impact member from its retracted position.

11. The apparatus of claim 10 wherein said releasing means is mounted on said movable frame.

12. The apparatus of claim 10wherein said locking means comprises a latch having a notch mounted on said movable frame for engaging a locking pin mounted on said impact member for locking said impact member at its retracted position.

13. The apparatus of claim 10 wherein said rotating means comprises:

a housing mounted on said movable frame;

a releasing handle pivotally connected at one end to said housing for rotational movement between a starting position and a releasing position, said handle is rotated from its starting position to its releasing position by an operator to rotate said locking means to release said impact member;

a pulley secured to said shaft for rotating said shaft; and a cord connected to said handle and convoluted around said pulley for rotating said pulley to rotate said shaft so that when said handle is rotated to its releasing position said impact member is released.

14. The apparatus of claim 13 wherein said rotating means further comprises means for automatically rotating said handle from its releasing position to its starting position.

15. The apparatus of claim 14 wherein said automatic rotating means comprises:

an arm secured at one end to said shaft for rotating said shaft in a direction opposite to that of said handle; and a resilient member connected at one end within a housing mounted on said movable frame and connected at the other end to said arm for providing tension on said arm when said handle is rotated to its releasing position so that said handle is automatically rotated from its releasing position to its starting position by said resilient member.

16. The apparatus of claim 15 wherein said resilient member is a spring.

17. A method of teaching offensive pass blocking techniques comprising:

providing the apparatus described in claim 1;

providing an operator to operate the apparatus;

providing a player to be trained on the apparatus;

said operator selectively manipulates said movable frame horizontally laterally and releases said impact member for advancement from its retracted position to its extended position; and said player reacts to and contacts said impact member and returns said impact member to its retracted position for repeated contact.

18. An apparatus for training football techniques comprising:

a support frame provided with a first end and a second end;

a movable frame mounted on said support frame for selective lateral movement with respect to the first and second ends;

an impact member having a padded area mounted on said movable frame for reciprocal movement between an extended and a retracted position, the extended position being outwardly and generally toward a player being trained on the apparatus, said impact member being returnable from its extended position to its retracted position by the player;

means for selectively releasing said impact member by an operator from its retracted position, said releasing means comprises (a) means for locking said impact member in a retracted position, (b) a rotatable shaft on which said locking means is mounted, and (c) means for rotating said shaft so that it rotates said locking means to release said impact member from its retracted position, said rotating means comprises (i) a housing mounted on said movable frame, (ii) a releasable handle pivotally connected at one end to said housing for rotational movement between a starting position and a releasing position, said handle is rotated from its starting position to its releasing position by an operator to rotate said locking means to release said impact member, (iii) a pulley secured to said shaft for rotating said shaft, and (iv) a cord connected to said handle and convoluted around said pulley for rotating said pulley to rotate said shaft so that when said handle is rotated to its releasing position, said impact member is released.

* * * * *